US011618267B2

(12) United States Patent
Hiller et al.

(10) Patent No.: US 11,618,267 B2
(45) Date of Patent: Apr. 4, 2023

(54) SYSTEM AND METHOD FOR PRINTING UPON AN ARTIFICIAL FISHING LURE BODY

(71) Applicant: Hangry Brand Enterprises, L.L.C., Brighton, MI (US)

(72) Inventors: Jennifer Leigh Hiller, Brighton, MI (US); Michael James Hiller, Brighton, MI (US)

(73) Assignee: Hangry Brand Enterprises, L.L.C., Brighton, MI (US)

( * ) Notice: Subject to any disclaimer, the term of this patent is extended or adjusted under 35 U.S.C. 154(b) by 6 days.

(21) Appl. No.: 17/484,708

(22) Filed: Sep. 24, 2021

(65) Prior Publication Data

US 2022/0097420 A1 Mar. 31, 2022

Related U.S. Application Data

(60) Provisional application No. 63/083,373, filed on Sep. 25, 2020.

(51) Int. Cl.

| | |
|---|---|
| ***B41J 11/00*** | (2006.01) |
| ***B41J 2/21*** | (2006.01) |
| ***B41M 5/00*** | (2006.01) |
| ***B41M 7/00*** | (2006.01) |

(52) U.S. Cl.
CPC ..... *B41J 11/00214* (2021.01); *B41J 2/2114* (2013.01); *B41M 5/0023* (2013.01); *B41M 7/0081* (2013.01)

(58) Field of Classification Search
CPC .... B41J 11/00214; B41J 2/2114; B41J 3/407; B41M 5/0023; B41M 7/0081
See application file for complete search history.

(56) References Cited

U.S. PATENT DOCUMENTS

2019/0021299 A1* 1/2019 Fishback, Jr. ..... A01K 85/00

* cited by examiner

*Primary Examiner* — Bradley W Thies
(74) *Attorney, Agent, or Firm* — Quinn IP Law

(57) ABSTRACT

A system for printing upon an artificial fishing lure body is provided. The system includes a printing device. The printing device includes a printing head operable to spray at least one liquid substance onto the artificial fishing lure body and an ultraviolet light emitting device operable to apply an ultraviolet light beam upon the fishing lure body and dry the at least one liquid substance. The system further includes a fixturing tray including a fixturing detail operable to hold the artificial fishing lure body while the artificial fishing lure body is sprayed.

18 Claims, 6 Drawing Sheets

SYSTEM AND METHOD FOR PRINTING UPON AN ARTIFICIAL FISHING LURE BODY

CROSS-REFERENCE TO RELATED APPLICATIONS

This disclosure claims priority to Provisional Patent Application No. 63/083,373 filed on Sep. 25, 2020, which is hereby incorporated by reference.

INTRODUCTION

The disclosure generally relates to a system and method for printing upon an artificial fishing lure body.

Artificial fishing lures are used to attract and catch fish. Fishing lures are created in a wide variety of shapes and sizes. Soft fishing lures may be constructed with a polyvinyl chloride and an oil-based resin mixture and may be formed into a shape attractive to a fish, such as a worm, crayfish, or into a tubular jig body. Fly-fishing lures may include a mixture of feathers and thread tied around a hook. Hard-bait lures may include a lure body, with one or more hooks or treble hooks attached thereto. Examples of hard-bait lures may include spoons, crankbaits, and floating minnows.

Hard-bait lures may include a metallic, polymerized, or wooden lure bodies, with a paint coating upon the lure body to provide an attractive appearance to the lure body. Some paint coatings are created to mimic prey fish or prey creatures upon which a target species of fish may eat. Some paint coatings provide a particular color or pattern of colors selected to induce a fish to strike the lure. Some paint coatings include flash or shine selected to similarly induce a fish to strike the lure. Some paint coatings may be selected to attract consumers, for example, with a logo, photographic image, or a personal message displayed upon the lure body.

Applying a paint coating upon a lure body may be a costly and labor-intensive process. In one embodiment, painting one side of a lure body may include priming the lure body, permitting the primer to air dry, and a sequence of utilizing stencils and an air brush for air-striping, sealing, clear coating, buffing, and re-sealing the lure body. One manufacturer has used marketing to boast that all of their lures take two days to paint.

SUMMARY

A system for printing upon an artificial fishing lure body is provided. The system includes a printing device. The printing device includes a printing head operable to spray at least one liquid substance onto the artificial fishing lure body and an ultraviolet light emitting device operable to apply an ultraviolet light beam upon the fishing lure body and dry the at least one liquid substance. The system further includes a fixturing tray including a fixturing detail operable to hold the artificial fishing lure body while the artificial fishing lure body is sprayed.

In some embodiments, the at least one liquid substance includes a colored paint.

In some embodiments, the colored paint includes a cyan paint, a magenta paint, and a yellow paint.

In some embodiments, the printing head is further operable to spray a primer.

In some embodiments, the printing head is further operable to spray a clear-coat liquid.

In some embodiments, the printing device includes an ultraviolet light-equipped flatbed inkjet printer. The colored paint includes a cyan paint, a magenta paint, and a yellow paint, the printing head is further operable to spray a primer, and the printing head is further operable to spray a clear-coat liquid.

In some embodiments, the fixturing tray includes a first fixturing tray, and the fixturing detail includes a first fixturing detail operable to hold the artificial fishing lure body in a first orientation. The system further includes a second fixturing tray including a second fixturing detail operable to hold the artificial fishing lure body in a second orientation inverted to the first orientation while the artificial fishing lure body is sprayed.

In some embodiments, the fixturing tray includes a first fixturing tray, and the fixturing detail includes a first fixturing detail operable to hold the artificial fishing lure body in a first orientation. The fixturing tray includes a second fixturing detail operable to hold the artificial fishing lure body in a second orientation inverted to the first orientation while the artificial fishing lure body is sprayed.

In some embodiments, the fixturing detail includes one of a depression formed in a surface of the fixturing tray, a raised surface protruding above the surface of the fixturing tray, or a pin operable to be inserted within a mating opening on the artificial fishing lure body.

In some embodiments, an ultraviolet light emitting device includes a light emitting diode.

In some embodiments, the ultraviolet light emitting device is formed integrally with the printing head.

According to one alternative embodiment, a system for printing upon an artificial fishing lure body is provided. The system includes a printing device. The printing device includes a printing head operable to spray at least one liquid substance including a colored paint onto the artificial fishing lure body, moveable tray platform, and an ultraviolet light emitting device operable to apply an ultraviolet light beam upon the fishing lure body and dry the at least one liquid substance. The system further includes a fixturing tray affixed to the moveable tray platform and including a fixturing detail operable to hold the artificial fishing lure body while the artificial fishing lure body is sprayed. The fixturing detail includes one of a depression formed in a surface of the fixturing tray, a raised surface protruding above the surface of the fixturing tray, or a pin operable to be inserted within a mating opening on the artificial fishing lure body. The printing head is controlled to automatically move in a left direction and a right direction over the fixturing tray. The moveable tray platform is controlled to automatically move in a forward direction and in a rearward direction. The colored paint includes a cyan paint, a magenta paint, and a yellow paint, the printing head is further operable to spray a primer, and the printing head is further operable to spray a clear-coat liquid.

According to one alternative embodiment, a method for printing upon an artificial fishing lure body is provided. The method includes disposing the artificial fishing lure body upon a fixturing tray, moving the fixturing tray within an ultraviolet light-equipped flatbed inkjet printer. The method further includes, within the ultraviolet light-equipped flatbed inkjet printer, utilizing a printing head to spray at least one liquid substance onto the artificial fishing lure body and applying an ultraviolet light beam upon the artificial fishing lure body to dry the at least one liquid substance.

In some embodiments, utilizing the printing head to spray the at least one liquid substance onto the artificial fishing lure body includes utilizing multiple passes of the printing head to create a three-dimensional pattern upon the artificial fishing lure body.

In some embodiments, utilizing the printing head to spray the at least one liquid substance onto the artificial fishing lure body includes spraying an etching chemical upon the artificial fishing lure body and applying the ultraviolet light beam upon the fishing lure body to dry the etching chemical. The method further includes, subsequent to applying the ultraviolet light beam upon the fishing lure body to dry the etching chemical, spraying a paint upon the artificial fishing lure body and applying the ultraviolet light beam upon the fishing lure body to dry the paint.

In some embodiments, utilizing the printing head to spray the at least one liquid substance onto the artificial fishing lure body includes spraying a primer upon the artificial fishing lure body and applying the ultraviolet light beam upon the fishing lure body to dry the primer. Utilizing the printing head to spray the at least one liquid substance further includes, subsequent to applying the ultraviolet light beam to the primer, spraying a paint upon the artificial fishing lure body and applying the ultraviolet light beam upon the fishing lure body to dry the paint. Utilizing the printing head to spray the at least one liquid substance further includes, subsequent to applying the ultraviolet light beam to the paint, spraying a clear-coat upon the artificial fishing lure body and applying the ultraviolet light beam upon the fishing lure body to dry the clear-coat.

In some embodiments, disposing the artificial fishing lure body upon the fixturing tray includes disposing the artificial fishing lure body upon a first fixturing detail upon the artificial fishing lure body. The method further includes, subsequent to applying the ultraviolet light beam upon the artificial fishing lure body, removing the artificial fishing lure body from the first fixturing detail and flipping the artificial fishing lure body to an inverted orientation. The method further includes disposing the artificial fishing lure body upon a second fixturing detail upon the fixturing tray and utilizing the printing head to spray the artificial fishing lure body in the inverted orientation.

In some embodiments, disposing the artificial fishing lure body upon the fixturing tray includes disposing the artificial fishing lure body upon a first fixturing detail upon the artificial fishing lure body. The method further includes, subsequent to applying the ultraviolet light beam upon the artificial fishing lure body, removing the artificial fishing lure body from the first fixturing detail and flipping the artificial fishing lure body to an inverted orientation. The method further includes disposing the artificial fishing lure body upon a second fixturing detail upon a second fixturing tray and utilizing the printing head to spray the artificial fishing lure body in the inverted orientation.

The above features and advantages and other features and advantages of the present disclosure are readily apparent from the following detailed description of the best modes for carrying out the disclosure when taken in connection with the accompanying drawings.

DETAILED DESCRIPTION

Figure 1:
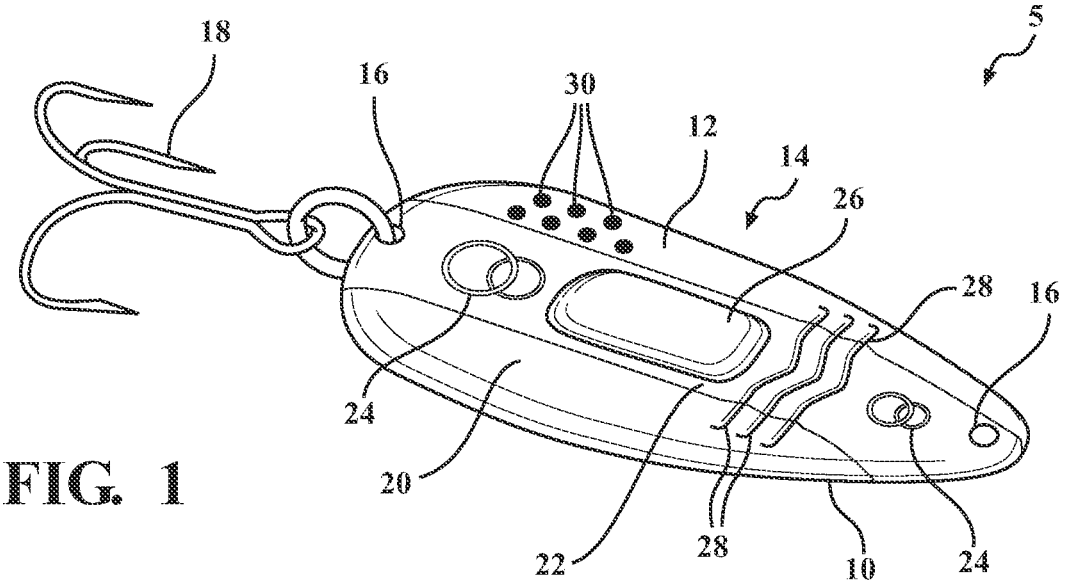
FIG. 1 schematically illustrates an exemplary fishing lure with paint applied thereto according to the method and system disclosed herein, in accordance with the present disclosure.

Artificial baits for fishing, which are attached to the end of a fishing line and equipped with a hook are readily available in a multitude of styles and a wide variety of material compositions, shapes, sizes, and illustrated features. Various individual or combined illustration sets (i.e. shapes, patterns, colors, hues, and artificial bait characteristics) are utilized to attract both fish to strike the lure and consumers to purchase the lure. Relatively minor changes in lure appearance may affect relatively large changes in fish behavior. However, lure patterns and paint configurations are difficult to tweak or try small variations thereupon.

Methods in the art for priming and/or appending illustrated designs, embossing fixtures, and/or affixing clear-coatings onto artificial fishing lure bodies primarily involve lengthy processes of painting or brushing on primers and illustrations, embossments, and clear-coatings by hand; but can also include using dyes or pre-printed stickers (e.g., decals).

Artificial fishing lure bodies or lure bodies that are hand painted by brush or airbrush take an inordinately long time to create. In many cases it takes days from start to finish just to create one illustrated lure. After the lure is thoroughly cleaned it may then be primed. The primers are then left to dry until the paint is no longer tacky. The lure is then cleaned again, oftentimes painted with a single color and left to dry. The painting and dry-time continues until as many colors and designs are applied as desired to create the particular illustration.

Painting by hand may be wildly inconsistent, but the process can include the use of stencil work which compounds the issue due to the difficulty of precision stencil placement by hand and the fact that paint builds up on the stencil over time and can create runoff, blotching, or overspray marks, which are both unintentional and undesirable in the finished work. When the priming and hand painting has concluded, may embossment and clear-coating begin. A practice in the art for creating embossments, such as attaching imitation fish eyes, is done via fastening the feature to the lure body with glue. There are a myriad of other clear-coat options on the market today. Further, painting by hand may limit designs that may be employed, for example, with some designs only being possible with the precision of computer-guided printing.

Dyes and conventional painting materials too are notoriously ineffective on bare metal surfaces that are composed of anything other than aluminum, titanium, or magnesium. Many metal fishing lure bodies are made from ½ hard cartridge brass, steel, or nickel-plated ½ hard brass or steel, materials which are notorious for being difficult to paint upon and tend to cause applied paint to flake off over time and usage. Other metal types which may be better substrates for painting purposes may be unusable as fishing lure bodies for other reasons (density, corrosion, high cost, etc.)

Printing paint or toner dyes upon bare metal surfaces poses challenges. Print applications upon metal are used in the art in signage and relegated to either stainless steel or aluminum metal surfaces, or clear-coat or pre-primed metal surfaces. The former being sometimes porous enough to accept inks from a print device, the latter being no different from time consuming processes using paints and clear-coatings previously discussed. Even when printing on these metal compositions the use of a standalone, separate process clear coat is employed.

Stickers, vinyl or otherwise, present serious challenges with flat adherence to tightly concave and/or convex surfaces which causes wrinkles in the vinyl that either stay in the design or need to be cut and overlapped, thus causing either unsightly and unwanted seams in the illustrations or the inability to cover the whole side of the artificial bait.

Furthermore, current techniques for embossing onto artificial fishing lure bodies primarily involve gluing on accessories such as faux fish eyes, then clear-coating over the top of the accessory. These accessories are either created as a secondary and stand-alone process or purchased from third parties for use. Either option results in a more complicated and less productive process.

Additionally, lure bodies that are popular today often do not have smooth finishes and will oftentimes have augmented surfaces created by the lure die press or molding process. Stickers, however, are quite unsuitable for adhering to any lure finish other than smooth surfaces. For example, when stickers are applied to hard-bait lure surfaces such as fish scale, hex, or hammered designs this leaves air pockets under the sticker and will oftentimes conceal the very exterior lure finish the angler was purchasing in the first place. Likewise, where lure bodies that include die stamped designs or manufacturer logos, the stickers reduce the three-dimensional artwork to flat, two-dimensional designs, thus lacking both texture and depth.

Hard-bait lure manufacturers are reluctant to bring new design illustrations to market due to the uncertainty of how well they will perform in the field and the significant time and costs involved. Field testing lure designs presents challenges for lure manufacturers. Customizable lure designs may be expensive or impractical to employ. An ability to create illustrated lure design features and publish them on hard-bait artificial lures has therefore been limited to either a.) teams within large corporations such as Berkley® and Rapala® or b.) to the owners and painters within a handful of smaller lure manufacturers such as Al's Goldfish lure Co., or Williams® Wabbler. Further, customizable lure vendors have offered simple consumer printing upon lure surfaces, for example, with cellular pictures being printed upon a pre-primed/pre-manufactured lure body with simple printer ink. Such consumer-grade printing, similar to widely-performed printing performed on paper surfaces, without use of etching chemicals or clearcoat protection and lacking texturing, would not be suitable for sustained fishing use and would lack flash/shine properties that induce fish strikes/improve the sporting performance of the lures.

Paint may be quickly cured or dried with an application of ultraviolet (UV) light. Computerized printers or printing devices are utilized in the art to apply ink or paint upon a substrate surface according to a programmed pattern. One embodiment of printer device may be described as a real-time UV equipped curable CMYK (cyan, magenta, yellow, and key color (wherein the key color may be black)) and white plus clear printer device. In one embodiment, such a real-time UV curable CMYK plus white plus clear printer may additionally be capable of applying an etching chemical to a bare lure body surface prior to an application of paint.

A system and method for printing upon artificial fishing lures is provided. One or more lure bodies may be loaded into a fixturing tray. The fixturing tray with at least one lure body is loaded into a real-time UV equipped curable CMYK and white plus clear printer device. In one embodiment, a printed for use with the disclosed method and system may be described as a UV equipped light emitting diode (LED) flatbed inkjet printer. Throughout the disclosure, primers, paints, inks, clear-coats, etching chemicals and other similar liquids are useful and may be applied through such a UV equipped LED flatbed inkjet printer through processes used in the art. Throughout the disclosure, paints and inks are intended to be similar or the same material, a pigmented liquid which may be applied to a lure body, a primer coat applied to a lure body, etc. and dried through an application of UV light. A programmed sequence including at least one iteration of applying a liquid coating upon the lure body and utilizing UV light to cure the liquid coating is performed. The liquid coating may include a primer and/or cyan, magenta, yellow, black, and white paint or ink. The liquid coating may include a clear coating. The liquid coating may include a liquid applied to create a three-dimensional pattern upon the lure body. Such a liquid used to create the three-dimensional pattern may include relatively increased viscosity to aid the liquid in staying in an applied shape until it is cured or dried with UV light. In another embodiment, multiple passes of a printing head with a same or a typical paint used upon a rest of the lure body may be used to create the three-dimensional pattern. The system and method may include flipping or adjusting the lure body upon the fixturing tray or utilizing a second fixturing tray to apply a liquid coating upon an additional portion of the lure body. When the lure body is initially bare metal, the system and method may include applying a rapid-drying, low viscosity etching liquid to the lure body prior to applying paint or a clear coating to improve adhesion.

Other types of printer devices may additionally or alternatively be utilized. For example, a pad printing head may be utilized which dips a pad into a liquid reservoir and then touches the pad to an artificial fishing lure body. In another embodiment, a printer device with multiple printing heads may be utilized, for example, with each of the printing heads performing different operations upon the artificial fishing lure body.

Referring now to the drawings, wherein like reference numbers refer to like features throughout the several views, FIG. 1 schematically illustrates an exemplary fishing lure 5 with paint applied thereto according to the method and system disclosed herein. The fishing lure 5 is an exemplary spoon lure includes a lure body 10 and a treble hook 18. The lure body 10 may include two end holes 16, a first for attachment of the treble hook 18 and a second for attachment to fishing line, a fishing wire leader, or other similar structure. The lure body 10 may be constructed with a metal substrate of constant thickness and may be bent or stamped into a concave shape on one side and a convex shape on the other side. The lure body 10 is illustrated including a first side 12 and a second side 14. The first side 12 and the second side 14 may both receive layers of paint. In one embodiment, some portion of the first side 12 and/or the second side 14 may include an unpainted shiny portion of exposed metal substrate, for example, to provide a fish strike inducing flash.

The first side 12 is illustrated including a paint layer 20 covering a left side of the lure body 10, a paint layer 22 covering a right side of the lure body 10, illustrated features 24 taking place of the paint layer 20 and paint layer 22 on the lure body 10, speckled paint dops 30 applied over a top of paint layer 20, three-dimensional ridge features 28 applied over the top of paint layer 22, and an attached decorative attachment 26.

Figure 2:
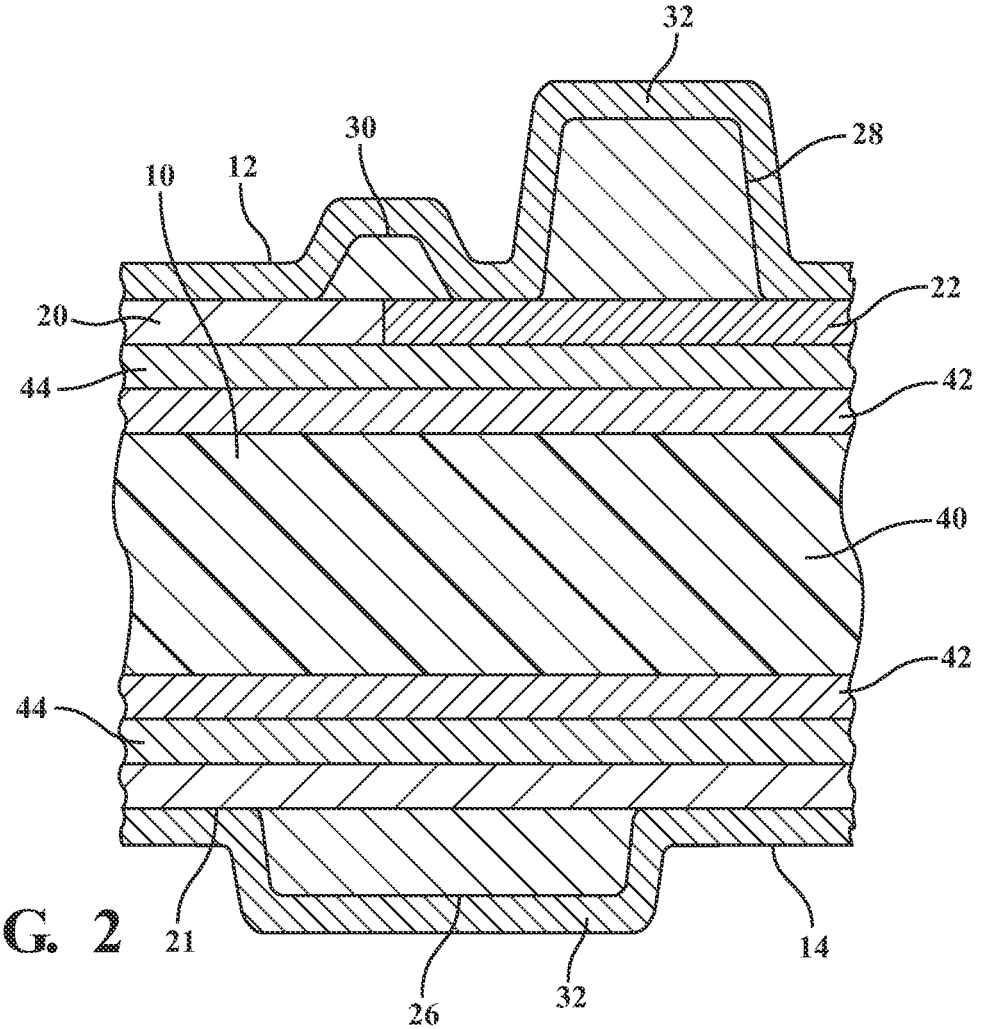
FIG. 2 schematically illustrates the lure body of FIG. 1 in cross-sectional view, with layers of primer, paint, three-dimensional features, decorative attachments, and a clear-coat illustrated thereupon, in accordance with the present disclosure.

FIG. 2 schematically illustrates the lure body of FIG. 1 in cross-sectional view, with layers of primer 44, paint 20, 22, a three-dimensional ridge feature 28, decorative attachment 26, and a clear-coat 32 illustrated thereupon. The lure body 10 is illustrated in cross-section, with various layers applied thereto. For purposes of clear illustration, the layers are illustrated in magnified detail as compared to a thickness of the lure body 10. The illustrated layers may be significantly thinner in relation to the thickness of the lure body 10 than as illustrated. The lure body 10 is illustrated including metal substrate material 40. An etching chemical has been applied to the outer surfaces of the lure body 10. The etching chemical may simply clean the outer surfaces of the lure body 10. In the embodiment of FIG. 1, the etching chemical has affected regions 42 of the metal substrate 40, increasing porosity within the affected regions 42 to increase adherence of applied layers to the metal substrate 40. The primer 44 is illustrated applied directly to the metal substrate 40.

Upon the first side 12, the paint layer 20 and the paint layer 22 are illustrated applied over the primer 44, meeting with each other, and staying in distinct areas relative to each other. The speckled paint dop 30 and the three-dimensional ridge feature 28 are illustrated applied over the paint layer 20 and the paint layer 22, respectively. A clear-coat 32 may be applied over a top of the other layers and features. Upon the second side 14, a paint layer 21 is illustrated applied over the primer 44, a decorative attachment 26 such as a sticker or decal is illustrated attached to the paint layer 21 with glue or other adhesive, and the clear-coat 32 is illustrated applied over the paint layer 21 and the decorative attachment 26. The features, shape, layers, materials, and other aspects of the fishing lure 5 are exemplary. A number of different variations are envisioned, and the disclosure is not intended to be limited to the examples provided herein.

Figure 3:
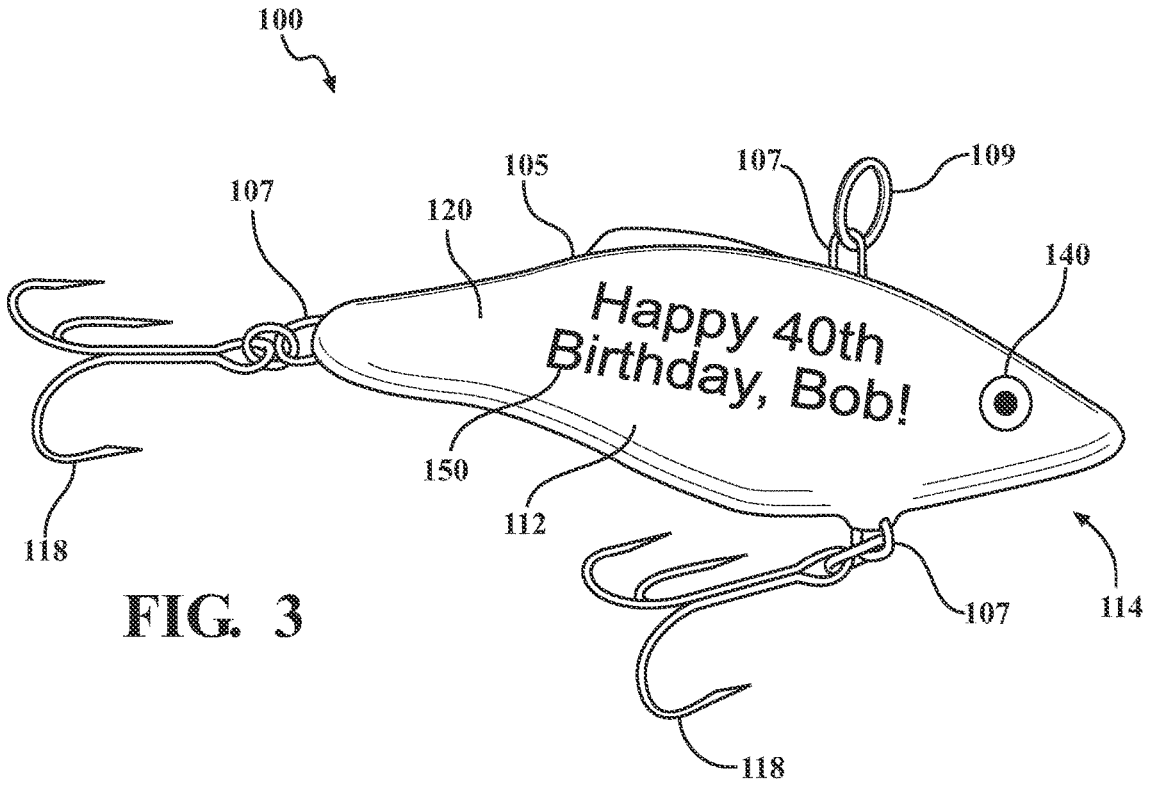
FIG. 3 schematically illustrates an alterative exemplary fishing lure with paint applied thereto according to the method and system disclosed herein, in accordance with the present disclosure.

FIG. 3 schematically illustrates an alternative exemplary fishing lure 100 with paint applied thereto according to the method and system disclosed herein. The fishing lure 100 is illustrated including lure body 105 and a pair of treble hooks 118. The fishing lure 105 includes an exemplary heavier-than-water lure which may include rattling ball features contained within the lure body 105. The lure body 105 may be constructed with a polymer or balsa wood, with relatively dense materials inside the lure body maintaining a desire buoyancy of the lure and providing metal wire loop features 107 projecting from the lure body 105 for attachment of the treble hooks 118 and an optional attachment loop 109. A first side 112 and a second side 114 of the lure body 105 are illustrated. A paint layer 120 is applied to the first side 112. Additionally, a decorative attachment 140 is illustrated attached to the paint layer 120. Additionally, a personalized printed textual print 150 is illustrated applied to paint layer 120.

Figure 4:
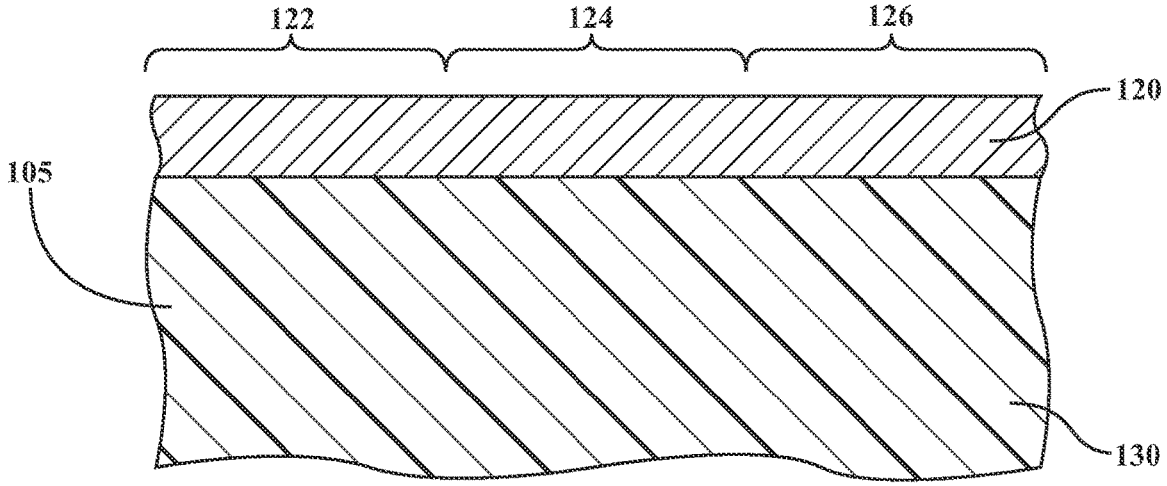
FIG. 4, schematically illustrates the lure body of FIG. 3 in cross-sectional view, with layers of paint being applied thereto, in accordance with the present disclosure.

FIG. 4, schematically illustrates the lure body 105 of FIG. 3 in cross-sectional view, with paint layer 120 being applied thereto. The lure body 105 is illustrated in cross-section, with various layers applied thereto. For purposes of clear illustration, the layers are illustrated in magnified detail as compared to a thickness of the lure body 105. The illustrated layers may be significantly thinner in relation to the thickness of the lure body 105 than as illustrated. Some materials may accept a layer of paint without a primer. Paint layer 120 is illustrated applied directly to a polymerized substrate 130 including a first portion 122 with one set of visual features, a third portion 126 including a second set of visual features, and a second portion 124 including a mixture of the visual features of the first portion 122 and the third portion 126. The first portion 122 may include paint of a particular color, hue, finish, additive sparkle content, etc., and the third portion 126 may include paint of another particular color, hue, finish, additive sparkle content, etc. The second portion 124 may be a physical mix of the paint used to create the first portion 122 and the third portion 126. In one embodiment, the second portion 124 may be selected as a desired transition between the first portion 122 and the third portion 126.

Figure 5:
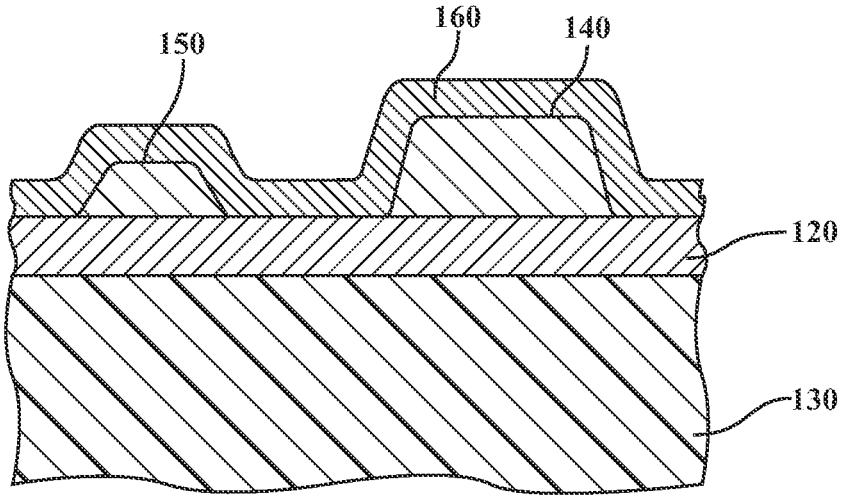
FIG. 5 schematically illustrates the lure body of FIG. 4 in cross-sectional view, with additional layers of decorative attachments, textual print, and clear-coat being applied thereupon, in accordance with the present disclosure.

FIG. 5 schematically illustrates the lure body of FIG. 4 in cross-sectional view, with additional layers of the decorative attachment 140, the textual print 150, and a clear-coat 160 being applied thereupon. The paint layer 120 is illustrated attached to the polymer substrate 130, and the decorative attachment 140 and the textual print 150 are illustrated applied to the paint layer 120. The clear-coat 160 is illustrated applied to the previously applied layer and features.

Figure 6:
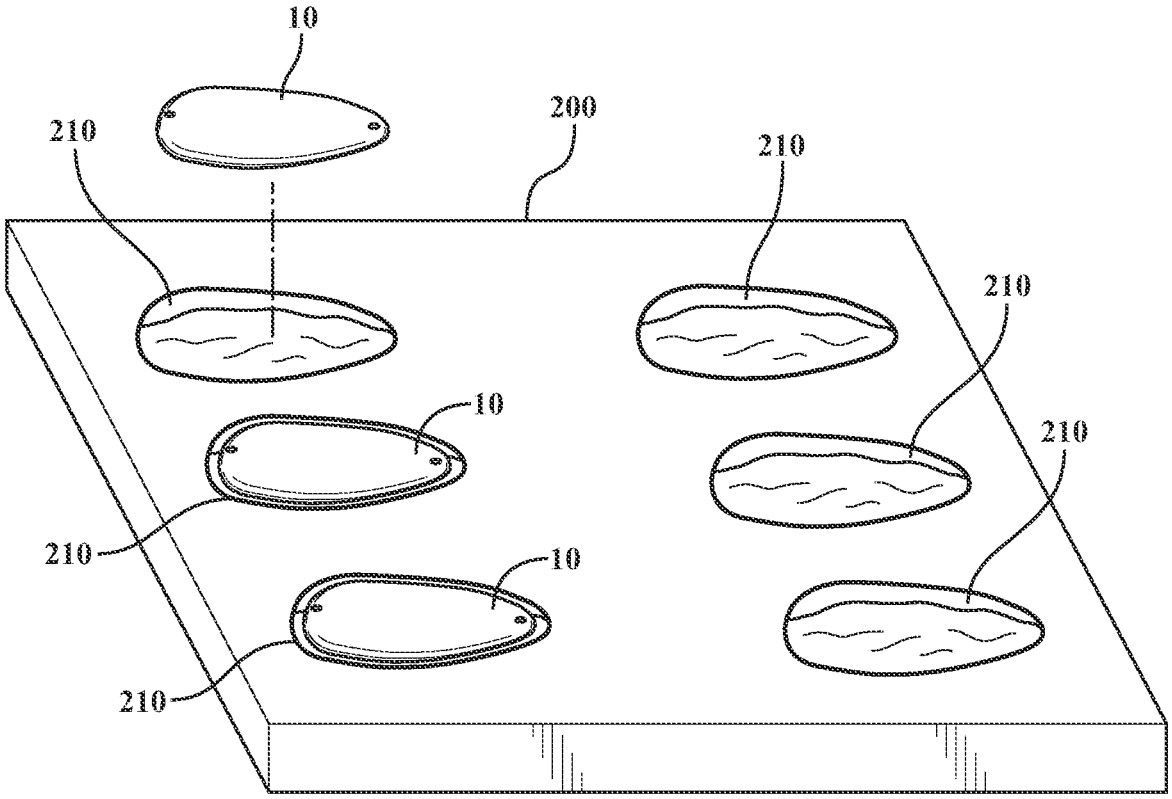
FIG. 6 schematically illustrates in perspective view an exemplary fixturing tray with a plurality of fishing lure bodies being deposited thereto in preparation for receiving layers of liquids in a printer device, in accordance with the present disclosure.

FIG. 6 schematically illustrates in perspective view an exemplary fixturing tray 200 with a plurality of fishing lure bodies 10 being deposited thereto in preparation for receiving layers of liquids in a printer device. The fixturing tray 200 includes a plurality of depressions 210. The depressions 210 are operable to receive the lure bodies 10 in at least one orientation. In one embodiment, the depressions are operable to receive the lure bodies 10 in a second orientation inverted to the first orientation, such that the lure bodies 10 may be painted upon one side and then flipped in the same fixturing tray 200 to be painted upon on a second side. In another embodiment, a second fixturing tray with similar depressions configured to receive the lure bodies 10 in the second orientation may be separately provided for painting of the second side.

Figure 7:
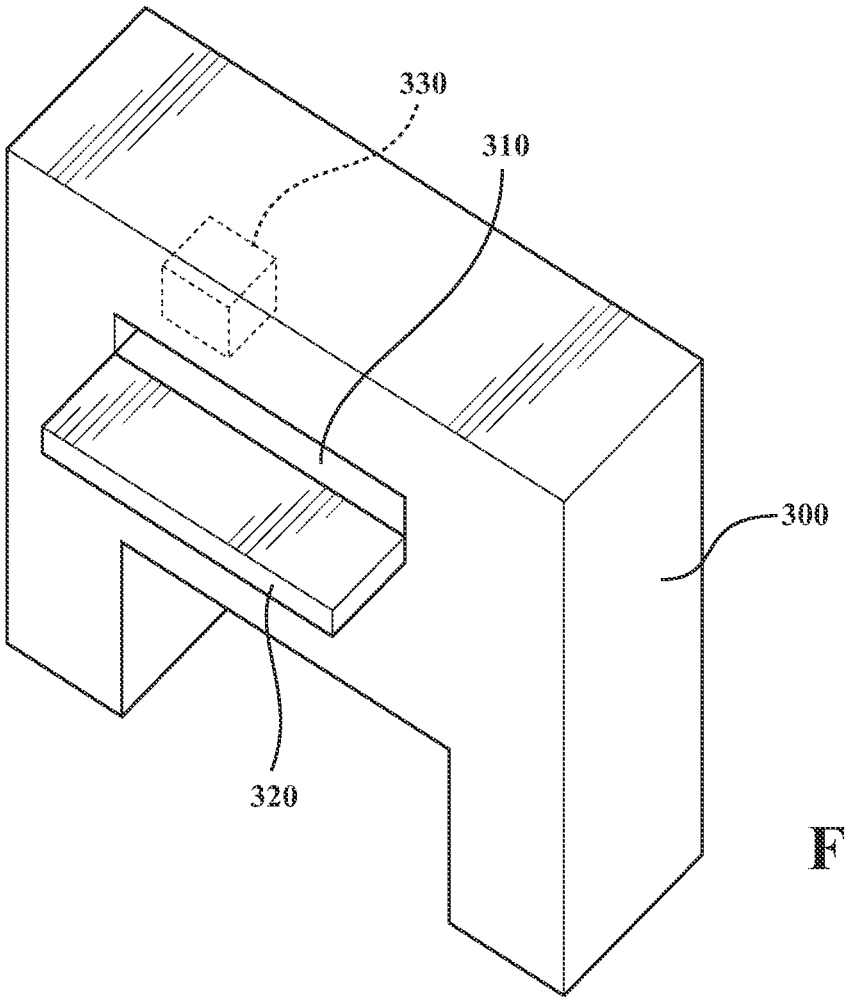
FIG. 7 schematically illustrates in perspective view an exemplary UV LED inkjet printer device useful according to the method and system disclosed herein, in accordance with the present disclosure.

FIG. 7 schematically illustrates in perspective view an exemplary UV LED inkjet printer device 300 useful according to the method and system disclosed herein. The UV LED inkjet printer device 300 is exemplary, and other similar printer devices with similar capabilities may be easily substituted for the illustrated device. The UV LED inkjet printer device 300 includes a device opening 310 useful to receive the fixturing tray 200 of FIG. 6. The UV LED inkjet printer device 300 may include a moveable tray platform 320 useful to receive the fixturing tray 200 of FIG. 6 thereupon and then move the fixturing tray 200 into the device opening 310. The moveable tray platform 320 may include pins, guide rails, a rectangular depression, or other features to permit the fixturing tray 200 to be repeatably disposed upon a same location upon the moveable tray platform 320 and to be held in place while the lure bodies 10 are being painted. Within the device opening 310, a printer/UV treatment head 330 may be translated back and forth over the fixturing tray 200 and lure bodies 10 disposed thereupon. In one embodiment the moveable tray platform 320 may be further operable to move the fixturing tray 200 forward and backward within the device opening 310 to further manipulate the printer/UV treatment head 330 over the lure bodies 10.

The UV LED inkjet printer device 300 is illustrated with a semi-manual operation being implied thereto, with one fixturing tray 200 being provided to the device at a time. It will be appreciated that the process may be automated, for example, with a conveyor system providing a stream of the fixturing trays 200 being constantly fed through the UV LED inkjet printer device. In one embodiment, a subsequent automated station upon the conveyor may flip the lure bodies 10 upon the fixturing tray 200, and a subsequent operation with the UV LED inkjet printer device 300 or a second UV LED inkjet printer device 300 being used to treat the flipped lure bodies 10.

Figure 8:
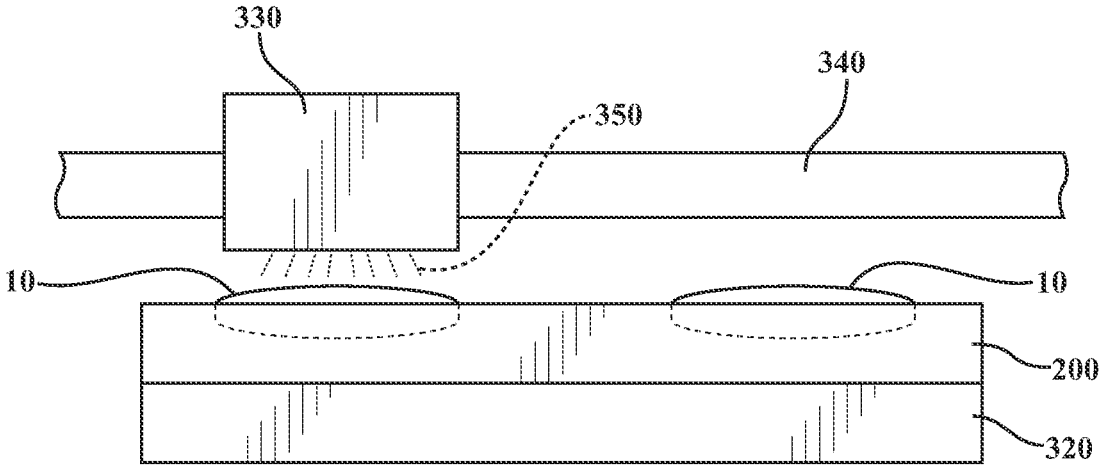
FIG. 8 schematically illustrates in front view a printer/UV treatment head of the printer device of FIG. 7 being used to apply a spray to a lure body, in accordance with the present disclosure.

FIG. 8 schematically illustrates in front view the printer/UV treatment head 330 being used to apply a spray 350 to a lure body 10. The printer/UV treatment head 330 is illustrated enabled to traverse left and right upon head track 340. In other embodiments, the printer/UV treatment head 330 may be enabled to travel in two or three dimensions. In another embodiment, the printer/UV treatment head 330 may be controlled to selectively move left and right, and the moveable tray platform 320 of FIG. 7 may be controlled to selectively move forward and backward, such that coordinated control of the printer/UV treatment head 330 and of the moveable tray platform 320 may be utilized to paint lure bodies over a surface of an entire fixturing tray 200 of FIG. 6. The printer/UV treatment head 330 may be operable to apply any of the described liquids herein as layers to the lure body 10. The printer/UV treatment head 330 may further be able to activate a UV lamp providing a UV beam of a desired intensity to rapidly cure or dry liquids applied to the lure body 10. In one embodiment, the printer/UV treatment head may alternate, applying a layer of liquid, applying the UV beam, applying a second layer of liquid, again applying the UV beam, with successive operations continuing until desired operations upon the lure body 10 in the present orientation are completed.

Figure 9:
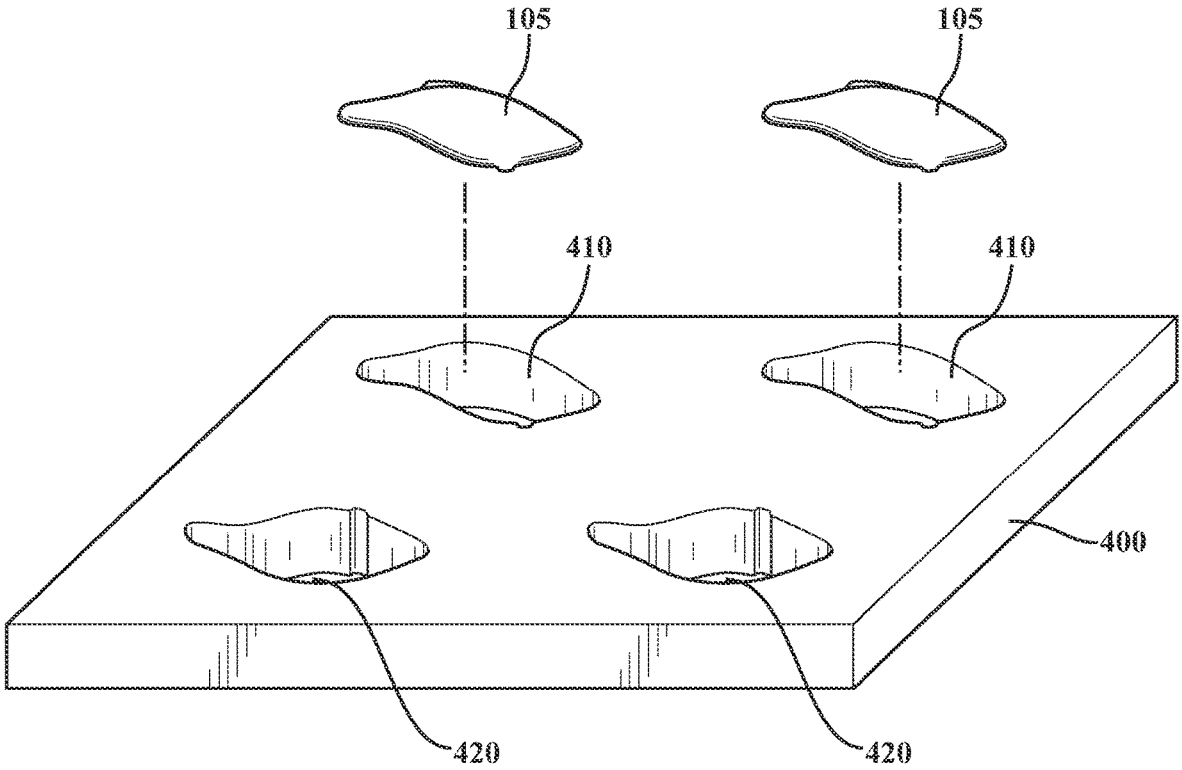
FIG. 9 schematically illustrates in perspective view an alternative exemplary fixturing tray including two sets of depressions, one for lure bodies in a first orientation and a second for the lure bodies in a second orientation inverted to the first orientation, in accordance with the present disclosure.

FIG. 9 schematically illustrates in perspective view an alternative exemplary fixturing tray 400 including a first set of depressions 410 and a second set of depressions 420, with the first set of depressions 410 being configured to receive lure bodies 105 in a first orientation and with the second set of depressions 420 being configured to receive the lure bodies 105 in a second orientation inverted to the first orientation.

Figure 10:
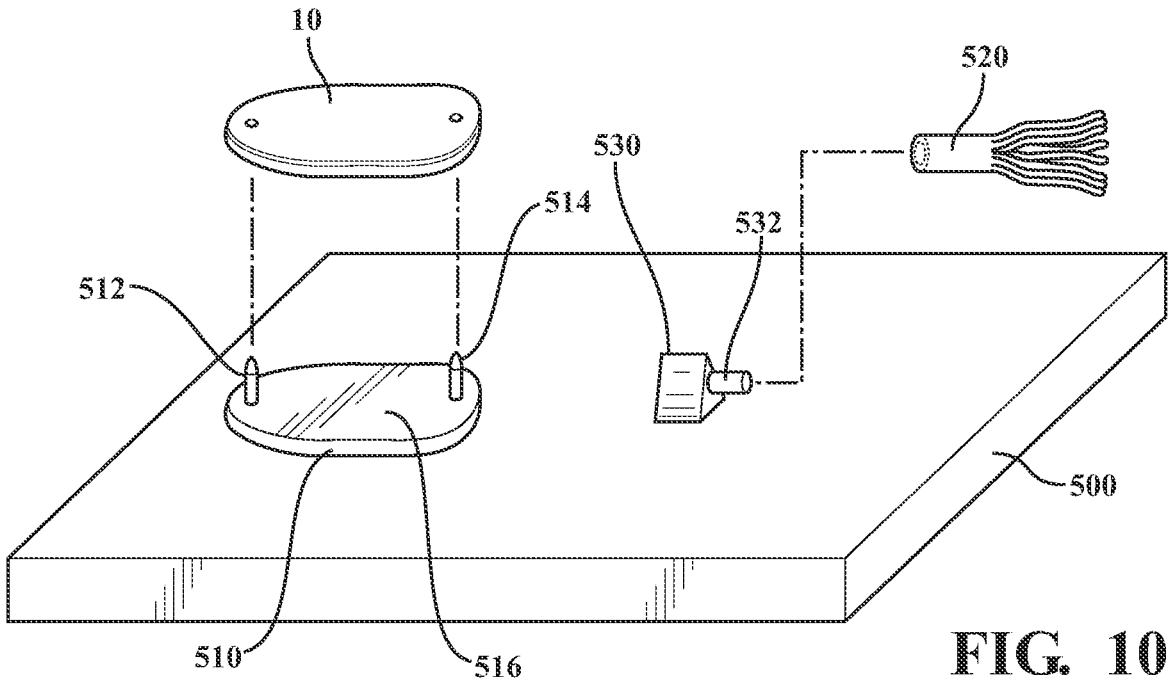
FIG. 10 schematically illustrates in perspective view an alternative exemplary fixturing tray including a first fixturing detail including a raised surface protruding above the surface of the tray and a second fixturing detail including a pin operable to be inserted within a mating opening on an artificial fishing lure body, in accordance with the present disclosure.

FIG. 9 illustrates an exemplary fixturing detail that may be utilized with a fixturing tray including one or more depressions operable to hold the artificial fishing lure body in a known position while it is being sprayed. FIG. 10 schematically illustrates in perspective view an alternative exemplary fixturing tray 500 including a first alternative fixturing detail 510 and a second alternative fixturing detail 530. The first alternative fixturing detail 510 includes a raised surface 516 protruding above the surface of the fixturing tray 500. The first alternative fixturing detail 510 further includes a first pin 512 and a second pin 514 operable to fit within mating openings upon the lure body 10. A combination of a shape of the raised surface 516 matching a shape of a bottom of the lure body 10 and of the pin 512 and the pin 514 fitting within openings upon the lure body 10 create a known position of the lure body 10 upon the fixturing tray 500.

Similarly, the second alternative fixturing detail 530 includes a pin 532. The pin 532 is operable to be inserted within a center portion of a hollow artificial fishing lure body 520. The artificial fishing lure body 520 includes an exemplary soft-body lure including a rubberized tubular jig body which may be constructed of exemplary plastisol or vinyl plastic. Bu fully inserting the pin 532 into the artificial fishing lure body 520, the artificial fishing lure body 520 is disposed in a known position upon the fixturing tray 500.

For the printer device to accurately print upon the lure body or lure bodies disposed on the fixturing tray, a location or position of the lure bodies may be determinable. For example, the fixturing tray may be affixed to the printer device, such that a location of fixturing details upon the fixturing tray is knowable. In this way, a lure body precisely placed upon the fixturing details is disposed in a known position, and a print head of the printer may be controlled through a series of motions and spray commands to accurately imprint a desired illustration upon the lure body. In another embodiment, the printer device may include a camera or other sensor device that may gather data regarding a location of a lure body placed within the printer device, and that gathered data may be processed to accurately control the printer head through a series of motions and spray commands to precisely imprint a pattern upon the lure body. In one embodiment, a fixturing tray may include a printed pattern there upon which may be recognized and processed by the printer to determine a location and orientation of the fixturing tray.

Figure 11:
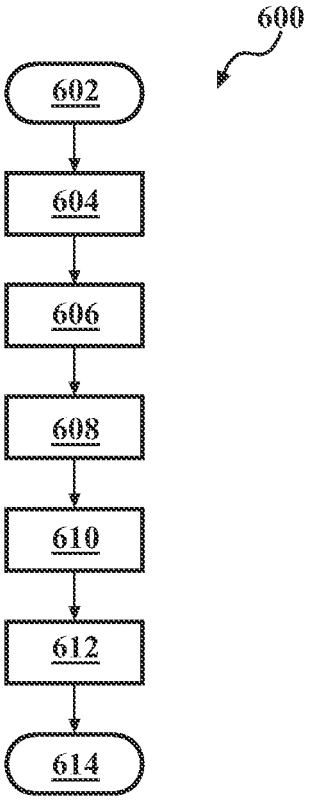
FIG. 11 is a flowchart illustrating a method for printing upon an artificial fishing lure body, in accordance with the present disclosure.

FIG. 11 is a flowchart illustrating a method 600 for printing upon an artificial fishing lure body. The method 600 starts at step 602. At step 604, a plurality of artificial fishing lure bodies is each disposed upon, loaded within, or affixed to fixturing details upon a fixturing tray, and the fixturing tray is loaded within a UV LED flatbed inkjet printer. At step 606, a printing head is operated to spray upon the artificial fishing lure bodies a first liquid substance. This first liquid substance may include an etching chemical, a primer, or one or more paints. At step 608, a UV light source is utilized to direct UV light beams of a desired intensity upon the first liquid sprayed upon the artificial fishing lure bodies for a time period sufficient to dry the first liquid substance. At step 610, a printing head is operated to spray upon the artificial fishing lure bodies a second liquid substance. This second liquid substance may include one or more paints or a clear-coat. At step 612, the UV light source is utilized to direct UV light beams of the desired intensity upon the first liquid substance sprayed upon the artificial fishing lure bodies for a time period sufficient to dry the second liquid substance. At step 614, the method 600 ends, and the painted lure bodies may be further processed for shipping or sale. A number of additional or alternative method steps are envisioned, for example, a mechanical lure flipping device may be utilized after step 612, the artificial fishing lure bodies may be reset upon the fixturing tray in an inverted orientation, and the method step 606, the method step 608, the method step 610, and the method step 612 may be operated again to paint the artificial fishing lure body in the inverted orientation. In another embodiment, multiple passes of paint spray may be applied to the artificial fishing lure body before the UV light source is activated, thereby permitting some mixing of the paint spray. In another embodiment, the illustrated alternating method steps including spraying and drying may be repeated multiple times to achieve as many layers of material upon the artificial fishing lure body as is useful. The disclosure provides exemplary method steps, and the disclosure is not intended to be limited to the examples provided herein.

Hard-bait lure bodies made from metals other than ½ hard brass, nickel-plated ½ hard brass, or nickel-plated steel may be used. Non-metal or non-plastic composite, hard-bait lure bodies may be used.

Illustrations may be non-stochastic or not random patterns. A method for creating an electronic illustration for printing is through a combination of manual vector art, color and design duplication of illustrations created by hand, or using pre-existing and readily available, open-source illustration designs; for example, using the open-source software, INKSCAPE.

Illustrations used upon the lure bodies may be stochastic. Images may be created in a myriad of different ways with or without the aid of computer programs or software programming.

In one embodiment, a UV curable, 5 color (CMYK, and White), plus Clear ink printer may include a Direct Jet LED UV flatbed printer by Direct Color Systems®. The UV printer may be capable of UV curing of inks in real-time, simultaneously while the system prints the electronic illustrations.

Various real-time curable ink print devices are available, and any of those machines may be used to print electronic illustrations.

In one embodiment, the inks for real-time UV LED, artificial lure printing are Multisolve™ IRF6T White, IRF6, IRF4, & IR2 Pigmented & UV-Stable UV LED, Inks by Direct Color Systems®. In one embodiment, the products may be compatible with the real-time UV curable, 5 color (CMYK, and White), plus Clear, Direct Jet LED UV printer, by Direct Color Systems®.

Various real-time curable inks are available, and any of those may be used to print electronic illustrations.

In one embodiment, a low viscosity primer used on bare metal hard-baits for the purpose of etching and adhesion promotion may include Verifix® by BOHLE®. In one embodiment, the combination of phosphonic acid and Bis (methacryloyloxyethyl) hydrogen phosphate has proven effective in promoting durability and rigidity in print surfaces. Describing durability, the ink stays on the lure over time, even when submerged in water as is performed with fishing techniques. Describing rigidity, the ink is less prone to flaking, even when colliding with underwater structure, as is common during employment of fishing techniques.

Phosphoric acid may useful in some embodiments, in bare metal etching. In one embodiment, phosphoric acid may be excellently utilized with Bis(methacryloyloxyethyl) hydrogen phosphate as a low-viscosity compliment for both phosphoric acid and isopropyl alcohol. Bis(methacryloyloxyethyl) hydrogen phosphate when used in proportion to phosphoric acid, has a thinning effect, thus reducing the viscosity of the solution and creating a situation where the etchment may be applied and dry quickly without the overburden of residual residue. This method allows for bare metals such as brass and nickel to be etched at a supramolecular level, and therefore improving adherence of ink/s to bare metal at a nano level.

Various adhesion promotion products exist including isopropyl alcohol, phosphoric acid and isopropyl alcohol, and any of those may be used for purposes of etching. Phosphonic acid and phosphoric acids are tautomers, compounds which differ in the orientation of their protons and electrons, and each are derivatives of phosphorus acid, and both are similarly effective as etchments for purposes described above.

In one embodiment, the print sequence may include etching with a low viscosity primer by wiping the surface of the lure to be printed with a cloth and allowing it to dry, priming the lure with a solid base color, and then printing the illustration on one side of the lure. Also useful is the simultaneous embossment of one portion of the printed side/s of the lure. For instance, an embossed faux, fisheye. Also useful is then to apply a UV cure gloss clear-coat, including for example Alumi-UV by Amulilite.

Lure bodies may be etched and not print primed; or conversely, print primed and not etched. For instance, bare metal lure bodies may be etched, not primed, and print illustrated to give the lure a darker and more metallic hue appearance. Non-bare metal lure bodies may not be etched but may be print primed a solid color.

Lure bodies may be print primed using a transparent or semi-transparent base coat/primer in lieu of a solid base coat or print primed but illustrated using another method. Lure bodies may be print illustrated but not initially print primed. For instance, lure bodies may be print primed and then illustrated with an airbrush.

Print primers, illustrations, and/or textures may be printed on one half or on one side of the lure. For instance, casting or trolling spoons with diecast designs to improve light reflectivity may be printed on approximately 50% of either the concave or convex side. They may be printed on the whole of the side, either the concave or convex side.

A print embossment may or may not be utilized using a method other than real-time UV cure print embossing. For instance, artificial lure bodies could be print primed and/or print illustrated and then embossed using another method, such as the glue-on method for an a la carte accessory utilization.

A lure may be primed and illustrated using another method but print embossed using the real-time UV cure ink/s. For instance, a lure may come pre-primed from the manufacturer, then illustrated using an airbrush, but then placed in a tray and print embossed using real-time UV cure ink/s.

A clear-coat may or may not be applied using a method other than real-time UV cure ink. For instance, artificial lure bodies could be print illustrated and/or print primed and then sealed with a more traditional clear-coat such as lacquer or 2k urethane clear-coating.

A lure may be primed, illustrated, and/or embossed in a first process step using another method, but, in a second process set, be print clear-coated using real-time UV cure ink. For instance, a lure may come pre-primed from the manufacturer, then illustrated using an airbrush, but then placed in a tray and print clear-coated using real-time UV cure ink.

Examples of systems, equipment and/or apparatus, and methods according to the disclosed implementations are described in this section. These examples are provided exclusively to add context to and aid in the comprehension of the disclosed implementations. Implementations may be conducted without some of these specific details. In other instances, in order to avoid unnecessarily obscuring implementations, well known process/method steps have not been described in detail. Other applications are possible; thus, the following examples should not be taken as definitive or limiting either in setting or in scope.

While the best modes for carrying out the disclosure have been described in detail, those familiar with the art to which this disclosure relates will recognize various alternative designs and embodiments for practicing the disclosure within the scope of the appended claims.

What is claimed is:

1. A system for printing upon an artificial fishing lure body, comprising:

a printing device, including:

a printing head operable to spray at least one liquid substance onto the artificial fishing lure body; and an ultraviolet light emitting device operable to apply an ultraviolet light beam upon the fishing lure body and dry the at least one liquid substance; and a fixturing tray including a fixturing detail operable to hold the artificial fishing lure body while the artificial fishing lure body is sprayed.

2. The system of claim 1, wherein the at least one liquid substance includes a colored paint.

3. The system of claim 2, wherein the colored paint includes a cyan paint, a magenta paint, and a yellow paint.

4. The system of claim 2, wherein the printing head is further operable to spray a primer.

5. The system of claim 2, wherein the printing head is further operable to spray a clear-coat liquid.

6. The system of claim 2, wherein the printing device includes an ultraviolet light-equipped flatbed inkjet printer;

wherein the colored paint includes a cyan paint, a magenta paint, and a yellow paint;

wherein the printing head is further operable to spray a primer; and wherein the printing head is further operable to spray a clear-coat liquid.

7. The system of claim 1, wherein the fixturing tray includes a first fixturing tray;

wherein the fixturing detail includes a first fixturing detail operable to hold the artificial fishing lure body in a first orientation; and further comprising a second fixturing tray including a second fixturing detail operable to hold the artificial fishing lure body in a second orientation inverted to the first orientation while the artificial fishing lure body is sprayed.

8. The system of claim 1, wherein the fixturing tray includes a first fixturing tray;

wherein the fixturing detail includes a first fixturing detail operable to hold the artificial fishing lure body in a first orientation; and wherein the fixturing tray includes a second fixturing detail operable to hold the artificial fishing lure body in a second orientation inverted to the first orientation while the artificial fishing lure body is sprayed.

9. The system of claim 1, wherein the fixturing detail includes one of a depression formed in a surface of the fixturing tray, a raised surface protruding above the surface of the fixturing tray, or a pin operable to be inserted within a mating opening on the artificial fishing lure body.

10. The system of claim 1, wherein the ultraviolet light emitting device includes a light emitting diode.

11. The system of claim 1, wherein the ultraviolet light emitting device is formed integrally with the printing head.

12. A system for printing upon an artificial fishing lure body, comprising:

a printing device, including:

a printing head operable to spray at least one liquid substance including a colored paint onto the artificial fishing lure body;

moveable tray platform; and an ultraviolet light emitting device operable to apply an ultraviolet light beam upon the fishing lure body and dry the at least one liquid substance; and a fixturing tray affixed to the moveable tray platform and including a fixturing detail operable to hold the artificial fishing lure body while the artificial fishing lure body is sprayed, wherein the fixturing detail includes one of a depression formed in a surface of the fixturing tray, a raised surface protruding above the surface of the fixturing tray, or a pin operable to be inserted within a mating opening on the artificial fishing lure body;

wherein the printing head is controlled to automatically move in a left direction and a right direction over the fixturing tray;

wherein the moveable tray platform is controlled to automatically move in a forward direction and in a rearward direction;

wherein the colored paint includes a cyan paint, a magenta paint, and a yellow paint;

wherein the printing head is further operable to spray a primer; and wherein the printing head is further operable to spray a clear-coat liquid.

13. A method for printing upon an artificial fishing lure body, comprising:

disposing the artificial fishing lure body upon a fixturing tray;

moving the fixturing tray within an ultraviolet light-equipped flatbed inkjet printer; and within the ultraviolet light-equipped flatbed inkjet printer, utilizing a printing head to spray at least one liquid substance onto the artificial fishing lure body; and applying an ultraviolet light beam upon the artificial fishing lure body to dry the at least one liquid substance.

14. The method of claim 13, wherein utilizing the printing head to spray the at least one liquid substance onto the artificial fishing lure body includes utilizing multiple passes of the printing head to create a three-dimensional pattern upon the artificial fishing lure body.

15. The method of claim 13, wherein utilizing the printing head to spray the at least one liquid substance onto the artificial fishing lure body includes:

spraying an etching chemical upon the artificial fishing lure body;

applying the ultraviolet light beam upon the fishing lure body to dry the etching chemical;

subsequent to applying the ultraviolet light beam upon the fishing lure body to dry the etching chemical, spraying a paint upon the artificial fishing lure body; and applying the ultraviolet light beam upon the fishing lure body to dry the paint.

16. The method of claim 13, wherein utilizing the printing head to spray the at least one liquid substance onto the artificial fishing lure body includes:

spraying a primer upon the artificial fishing lure body;

applying the ultraviolet light beam upon the fishing lure body to dry the primer;

subsequent to applying the ultraviolet light beam to the primer, spraying a paint upon the artificial fishing lure body;

applying the ultraviolet light beam upon the fishing lure body to dry the paint;

subsequent to applying the ultraviolet light beam to the paint, spraying a clear-coat upon the artificial fishing lure body; and applying the ultraviolet light beam upon the fishing lure body to dry the clear-coat.

17. The method of claim 13, wherein disposing the artificial fishing lure body upon the fixturing tray includes disposing the artificial fishing lure body upon a first fixturing detail upon the artificial fishing lure body; and further comprising:

subsequent to applying the ultraviolet light beam upon the artificial fishing lure body, removing the artificial fishing lure body from the first fixturing detail;

flipping the artificial fishing lure body to an inverted orientation;

disposing the artificial fishing lure body upon a second fixturing detail upon the fixturing tray; and utilizing the printing head to spray the artificial fishing lure body in the inverted orientation.

18. The method of claim 13, wherein disposing the artificial fishing lure body upon the fixturing tray includes disposing the artificial fishing lure body upon a first fixturing detail upon the artificial fishing lure body; and further comprising:

subsequent to applying the ultraviolet light beam upon the artificial fishing lure body, removing the artificial fishing lure body from the first fixturing detail;

flipping the artificial fishing lure body to an inverted orientation;

disposing the artificial fishing lure body upon a second fixturing detail upon a second fixturing tray; and utilizing the printing head to spray the artificial fishing lure body in the inverted orientation.

* * * * *